United States Patent [19]

St-Gelais

[11] 4,242,953

[45] Jan. 6, 1981

[54] GARBAGE COLLECTING TRUCK

[76] Inventor: Denis St-Gelais, 110 de la Barre St., Longueuil, Quebec, Canada, J4K1A3

[21] Appl. No.: 43,657

[22] Filed: May 30, 1979

[30] Foreign Application Priority Data

May 10, 1978 [CA] Canada ..... 303044

[51] Int. Cl.[3] ..... B30B 7/00; B30B 15/32

[52] U.S. Cl. ..... 100/100; 100/102; 100/137; 100/188 R; 100/218; 100/232; 100/233; 296/24 R; 298/8 R; 298/18; 414/525 R

[58] Field of Search ..... 100/100, 232, 233, 245, 100/218, 102, 137, 188 R; 214/83, 503; 296/24 R, 101; 298/8 R, 18; 414/525

[56] References Cited

U.S. PATENT DOCUMENTS

| | | | |
|---|---|---|---|
| 222,160 | 12/1879 | Sherar | 298/18 |
| 507,425 | 10/1893 | Fowler | 100/188 |
| 1,588,681 | 6/1926 | Haney | 100/218 |
| 2,437,890 | 3/1948 | Orendorff | 298/18 |
| 2,961,977 | 11/1960 | Coleman | 100/102 |
| 3,170,389 | 2/1965 | Parks | 100/232 |
| 3,625,374 | 12/1971 | Hemphill | 100/100 |
| 3,711,157 | 1/1973 | Smock | 298/8 R |
| 3,841,234 | 10/1974 | Nicoletti | 298/18 |
| 4,113,125 | 9/1978 | Schiller | 414/525 X |

FOREIGN PATENT DOCUMENTS

| | | | |
|---|---|---|---|
| 230652 | 3/1970 | U.S.S.R. | 298/18 |

*Primary Examiner*—Billy J. Wilhite

[57] ABSTRACT

A garbage collecting truck having two separate compartments, one to receive recyclable materials, such as paper, fabric and the like, and the other to receive the remainder mainly non-recyclable waste of the garbage. The two compartments are of elongated shape, are mounted side by side on the truck chassis longitudinally of the same and both are inclined upwardly towards the front of the truck. Both compartments can be loaded from the rear of the truck by persons standing on the ground, and each has a hydraulic ram to push the loaded material forwardly. The recyclable material in the one compartment is formed into successive bales, any two of which can be stacked on a platform located ahead of the elevated discharge outlet of said one compartment. The non-recyclable waste collection compartment includes a lateral dumping outlet, a normally-latched door panel pivotally hung to close the dumping outlet, and, when unlatched, to open upon laterally outward pivoting of the compartment to dump the wastes through the dumping outlet.

4 Claims, 6 Drawing Figures

GARBAGE COLLECTING TRUCK

This invention relates to a garbage collecting truck.

The conventional garbage truck collects all the garbage together in a single compartment and does not provide for sorted loading of different garbage materials respectively in separate compartments of the truck. It is known that a fair proportion of domestic garbage is constituted of paper (newspapers), cardboard, fabric and the like materials, which are advantageous to recycle. The mixed loading of such materials with the other garbage results in much soiling of these materials and difficulty to sort them after.

It is a general object of the present invention to provide a garbage collecting truck in which paper, fabric and the like recyclable materials can be loaded in one compartment and the remainder of the garbage or the wastes can be loaded in a second compartment for convenient recycling of paper and fabric materials.

It is a further object of the present invention to provide a garbage recycling truck and which includes the recyclable materials are formed into bales for easy unloading and handling of these materials.

The above and other objects and advantages of the present invention will be better understood with reference to the following detailed description of a preferred embodiment thereof which is illustrated, by way of example, in the accompanying drawings, in which.

Figures 1, 2:
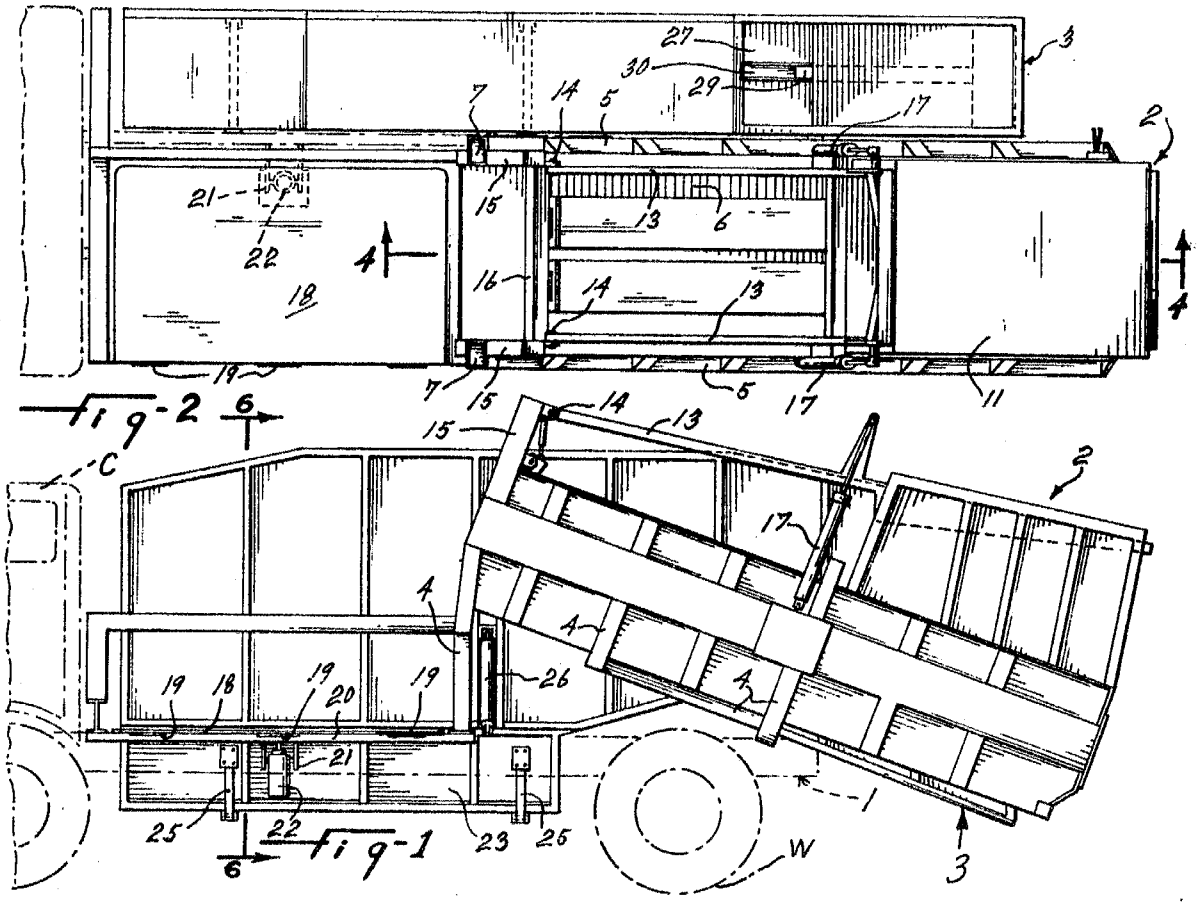
FIG. 1 is a side elevation view of the rear portion of a garbage collecting truck according to the present invention and as seen from the baling side thereof.
FIG. 2 is a top view of the rear portion of the garbage collecting truck shown in FIG. 1.

The illustrated garbage recycling truck includes a truck partly shown in phantom lines and comprising a truck chassis 1, of any conventional construction. The garbage collecting truck comprises a baling unit 2 and a waste collection unit 3 which are mounted side by side on the truck chassis; are both elongated, and extend lengthwise longitudinally of the truck chassis.

The baling unit 2 includes a hydraulic baling section rearwardly of a bale dumping device or section. The hydraulic baling section includes a frame structure 4 which is fixedly mounted on the truck chassis 1 and supports a pair of laterally opposite sides 5 and a bottom 6 which is longitudinally straight and which is upwardly inclined towards the front of the truck. The sides 5 and the bottom 6 are rigidly connected one to another to form a sturdy channel or slideway. Each side 5 forms a tubular passage, or channel 7, extending longitudinally thereof and laterally communicating inward with respect to the sides 5.

Figures 4, 5:
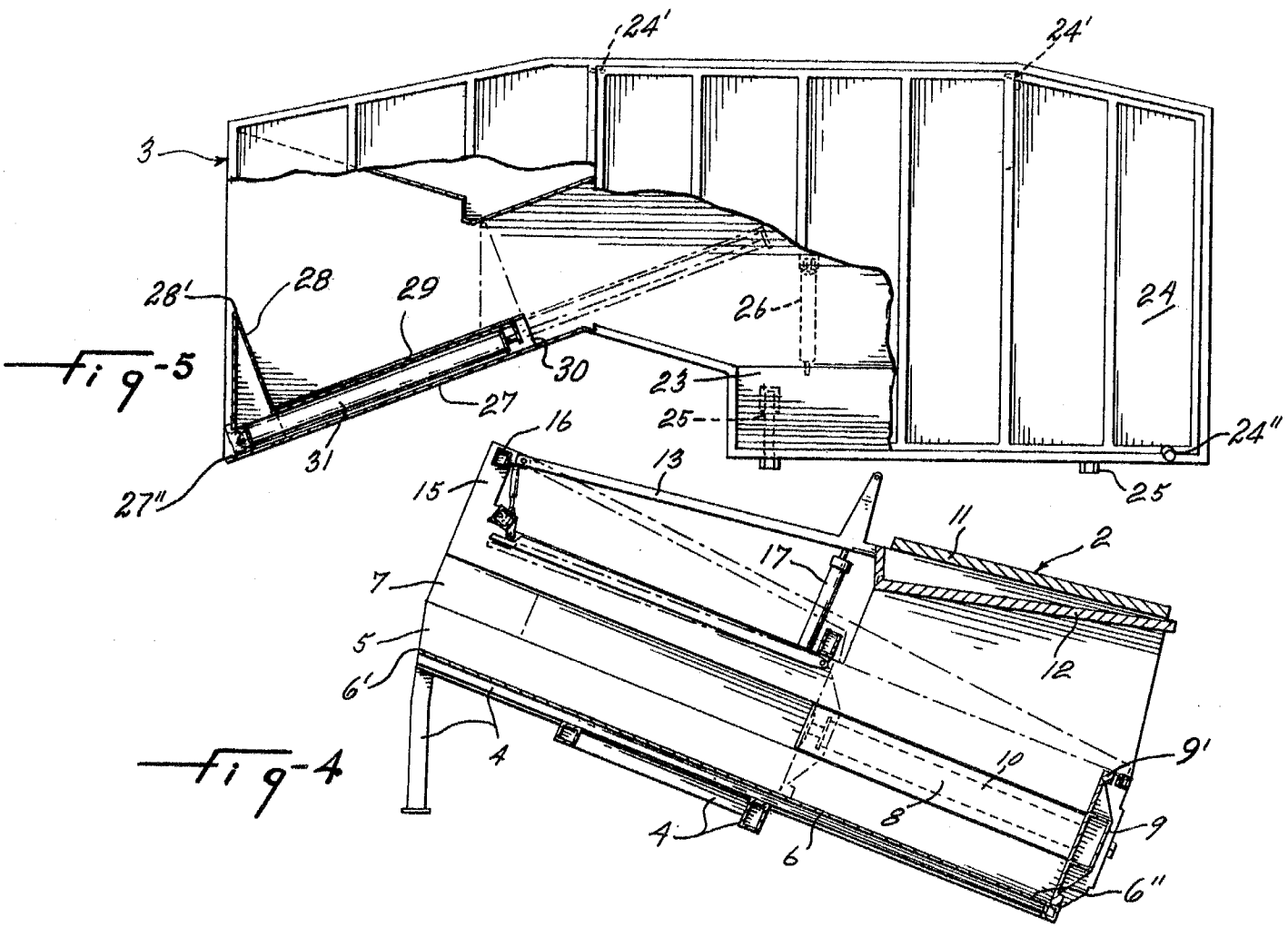
FIG. 4 is a cross-sectional view as seen along line 4—4 in FIG. 2.
FIG. 5 is a side elevation view of the rear portion of the garbage collecting truck as seen from the waste collection side thereof and partly in cross-section.

Each channel 7 forms a guideway for an elongated slide member 8, shown in FIG. 4. A compacting panel 9 extends transversely across the passage defined between the sides 5 and is fixedly secured at each end to the corresponding slide member 8. This compacting panel 9 rests edgewise on the bottom 6 to push the material forwardly thereof. A hydraulic cylinder 10 is connected in each channel 7 between the forward end of the corresponding slide member 8 and the rear end of the corresponding channel 7. Thus, the slide members 8, the compacting panel or press member 9, and the hydraulic cylinders 10 constitute a hydraulic press to compact a bale of paper, fabric or the like material forwardly on the upwardly rising bottom 6.

The two sides 5 are transversely and rigidly interconnected at their rearward end by a top plate or panel 11. A compacting plate, or panel 12, is positioned under the fixed top plate 11 and is pivotally connected to pivot up and down and downwardly compress or compact the bale of material at the rear of the baling section. A pair of arms 13 rigidly project forward from the compacting plate 12 and are pivoted at their forward end, at 14, to provide the above-mentioned up-and-down pivoting of the compacting plate 12. The pivots defining the pivot points 14 are pivotally carried by the frame structure of the baling unit, and more specifically by a pair of posts 15 rigidly interconnected at their upper end by a crossbar 16. A pair of hydraulic cylinders 17 are connected between the sides 5 and the arms 13, respectively, to operatively pivot the arms 13 and the plate 12 as afore described.

The bale dumping section includes a platform 18 located between the truck driver cabin C and the front discharge end 6' of bottom 6. Discharge end 6' is at a higher level than platform 18, such that two successily formed bales can be stacked on platform 18. The latter is pivoted by hinges 19 secured along the outer edge of this platform and of a fixed supporting frame 20. A bracket 21 is fixed to the truck chassis 1. A hydraulic cylinder 22 is pivotally carried by the bracket 21 and is connected to the dumping platform 18 to transversely pivot the latter outwardly and thus dump any bale having been pushed thereon by the hydraulic baling press.

Figure 6:
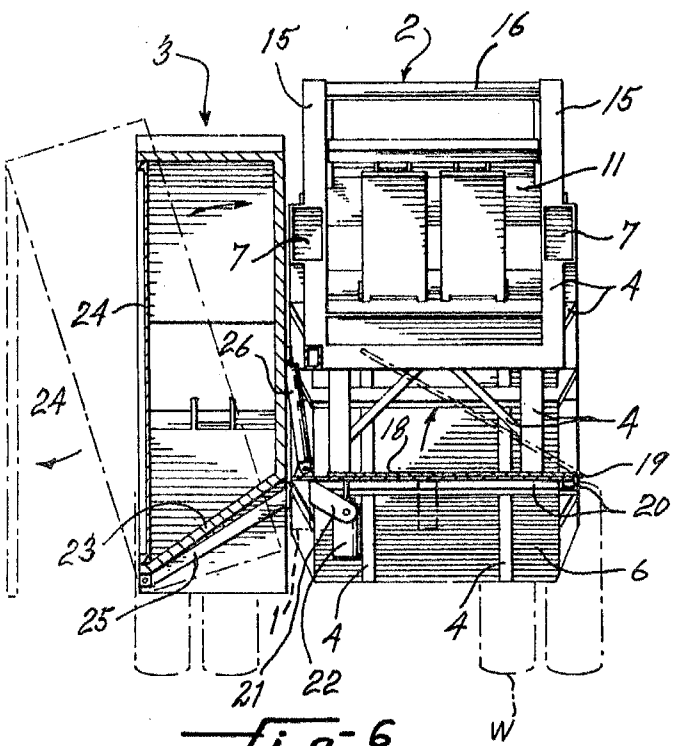
FIG. 6 is a cross-sectional view as seen along line 6—6 in FIG. 1.

The waste collection unit 3 has the form of a narrow and elongated box defining a forward waste collection chamber. The forward portion of the waste collection unit has a bottom 23 which is inclined downwardly outward, as shown in FIG. 6, such as to enhance dumping of the wastes out of the afore-mentioned chamber. The external side wall of the waste collection unit 3 is formed with a waste outlet aperture which is closed by a door panel 24 pivotally hung at its top edge at 24' (FIG. 5) in registry with this outlet aperture. Suitable latch means, shown at 24", are provided at the lower edge of floor panel 24 and at the forward waste collection chamber to retain door panel 24 in closed position.

Figure 3:
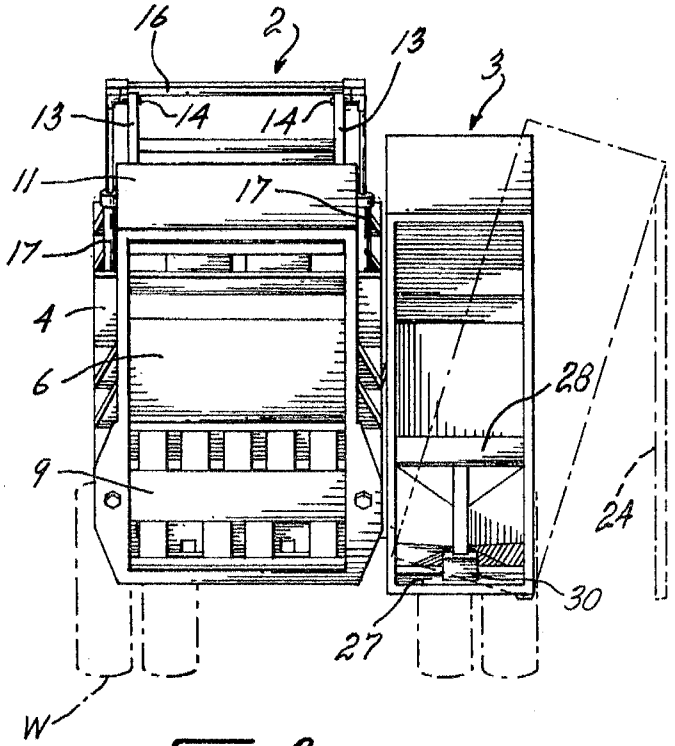
FIG. 3 is a rear view of the garbage collecting truck as seen from the right in FIGS. 1 and 2.

A pair of arms 25 are rigidly secured to the chassis 1 and outwardly project therefrom in opposite transverse direction relative to the baling unit 2. The waste collection unit 3 is pivoted along its bottom outer edge to the outer end of the rigid arms 25. A hydraulic cylinder 26 is connected to the truck chassis 1 and to the internal side of the waste collection unit and is adapted to transversely pivot the latter between the wastes holding position shown in full lines in FIGS. 3 and 6 and the dumping position shown in dotted lines in the same Figures. The door panel 24 is hung to pivot under gravity between a closed and an open positions upon unlatching of door panel 24 and mere transverse pivoting of the waste collection unit.

The waste collection unit 3, rearward of the waste holding chamber, includes a longitudinally straight bottom 27 and opposite sides cooperatively forming a trough which is upwardly inclined from the rear toward the waste collection chamber. A scraper blade 28 is fixedly secured on the rearward end of a slide 29 and upwardly projects from the bottom 27. The slide 29 is slidable in a groove or channel 30. A hydraulic cylinder 31 is connected to the slide 29 and extends in the channel 30 to displace the blade 28 to and fro in the afore-described trough.

It must be noted that the baling unit 2 and the waste collection unit 3 are arranged with their inlet aperture adjacent each other at the rear of the truck. The rear ends 6'' and 27'' of bottoms or floors 6 and 27, respectively of said units 2 and 3, are located behind the truck rear wheels W and at a lower level than the top of said rear wheels W, such that garbage can be easily loaded into the respective units over the top edge 9' of press panel 9 and top edge 28' of scraper blade 28, when said press panel 9 and scraper blade 28 are in their rearmost position adjacent bottom rear ends 6'' and 27'', respectively. Therefore the units are loaded from the rear by throwing the paper, fabric and the like materials ahead of the displaceable member 9 and the other garbage or wastes ahead of the scraper blade 28 by persons standing on the ground. When a sufficient amount of paper has been added, the displaceable member 9 is actuated by the cylinders 10 to form a bale and push it onto the dumping platform. Two successively formed bales can be stacked on platform 18. Upon actuation of the hydraulic cylinder 22, the finished bale is dumped off the platform. The wastes are pushed by the scraper blade 28 to accumulate into the waste collection chamber which is emptied by actuation of the hydraulic cylinder 26 to outwardly tilt the waste collection unit.

What I claim is:

1. A garbage collecting truck comprising a truck chassis mounted on front and rear wheels, a driver cabin mounted at the front of said truck chassis, two separate elongated refuse collecting compartments mounted side by side longitudinally of said truck chassis and rearwardly of said driver's cabin, each compartment comprising a bottom and upstanding side walls, each compartment open at its rear end, the bottom of each compartment being longitudinally straight and inclined upwardly in the forward direction relative to said truck, each bottom terminating at its rear end at a level below the top of said rear wheels and behind said rear wheels, a refuse pushing power-operated ram mounted in each compartment longitudinally movable along the bottom and between the side walls of the respective compartments from a rearmost loading position adjacent the rear end of the bottom in which the top edge of the ram is at a low enough level to permit manual refuse loading of the compartment over and ahead of said ram by persons standing on the ground behind the truck, one of said compartments serving to receive recyclable refuse mainly consisting of paper and fabric, the other of said compartments serving to receive mainly non-recyclable refuse, the bottom of said one compartment terminating short of said driver's cabin at its front end, a platform carried by said truck chassis and extending longitudinally of said truck intermediate said driver's cabin and the front end of said bottom of said one compartment and a lower level than the front end of said last-named bottom, said front end forming part of a discharge opening at the front of said one compartment, said one compartment, together with its ram serving to form successive bales of said recyclable refuse, which are pushed by said ram in said one compartment past said bottom front end and dropped onto said platform in a position to be unloaded from said truck, said other compartment extending longitudinally forward of said truck alongside said platform and forming a closed chamber at its front end portion, said front end portion having a side door in its side wall facing exteriorly of the truck, said other compartment power tiltable transversely of said truck for unloading of said other compartment upon opening of said side door.

2. A garbage collecting truck as claimed in claim 1, further comprising a power-operated compacting plate extending within said one compartment above the bottom thereof and pivotally connected at its forward end for up-and-down pivoting movement of said compacting plate towards and away from said bottom to compress material loaded within said one compartment transversely of the longitudinal movement of the ram in said one compartment.

3. A garbage collecting truck as claimed in claim 1, wherein said platform has an outer side edge extending lengthwise of the truck chassis and pivoted to the latter and further including power means connected to said truck chassis and to said platform to pivot the latter upwardly and laterally outward to unload a bale resting thereon.

4. A garbage collecting truck as claimed in claim 1, wherein said closed chamber of said other compartment has a downwardly and laterally outwardly inclined bottom to facilitate unloading of the material in said chamber upon tilting of said other compartment.

* * * * *